United States Patent [19]

Baczek et al.

[11] 4,006,725

[45] Feb. 8, 1977

[54] SPARK PLUG CONSTRUCTION FOR LEAN MIXTURE BURNING INTERNAL COMBUSTION ENGINES

[75] Inventors: Tadeusz A. Baczek; Leslie M. L. James, both of New Bedford, Mass.

[73] Assignee: Baczek and James Company, Inc., New Bedford, Mass.

[22] Filed: Mar. 12, 1976

[21] Appl. No.: 666,196

Related U.S. Application Data

[63] Continuation-in-part of Ser. No. 558,921, March 17, 1975, abandoned.

[52] U.S. Cl. ..... 123/32 SJ; 123/75 B; 123/32 SP

[51] Int. Cl.[2] ..... F02B 19/10; F02B 19/18

[58] Field of Search ..... 123/32 ST, 32 SJ, 32 SP, 123/75 B, 143 B, 191 S, 191 SP, 169 V, 169 EL, 169 P

[56] References Cited

UNITED STATES PATENTS

| | | | |
|---|---|---|---|
| 1,181,122 | 5/1916 | Eastman | 123/32 SP |
| 1,596,240 | 8/1926 | Pikeman | 123/191 S |
| 2,127,512 | 8/1938 | Harper | 123/169 P |
| 2,884,913 | 5/1959 | Heintz | 123/32 SP |
| 3,890,942 | 6/1975 | Date | 123/32 SP |
| 3,926,169 | 12/1975 | Leshner | 123/32 SJ |

*Primary Examiner*—Ronald B. Cox
*Attorney, Agent, or Firm*—Mason, Fenwick & Lawrence

[57] ABSTRACT

An internal combustion engine has a main combustion chamber defined by a cylinder bore and its associated piston and a valved intake passage for introducing a lean fuel-air mixture in the combustion chamber. A novel spark plug mounted in the engine in place of the conventional spark plug has an apertured dome portion defining a limited size spark ignition chamber about the spark gap and a valved branch passage to the ignition chamber connected to a first fuel supply, such as a rich fuel-air mixture source, to achieve ignition thereof in the ignition chamber causing a flame discharge which ensures ignition of another fuel mixture, such as a lean mixture, in the main combustion chamber. Alternatively, a conventional spark plug may be used with a special adaptor assembled on the gap end of the plug which provides the limited size spark ignition chamber and valved branch passage.

11 Claims, 8 Drawing Figures

Fig-5
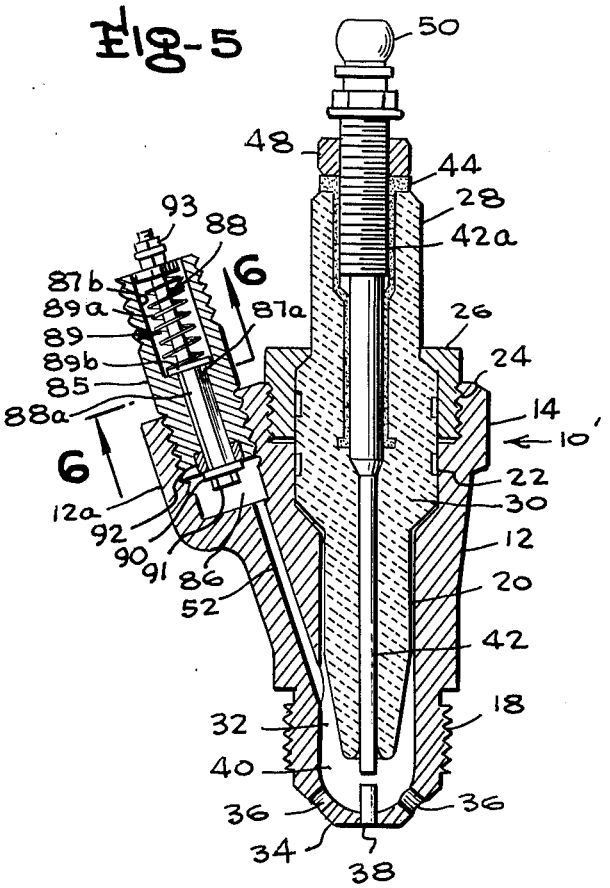
Fig-6
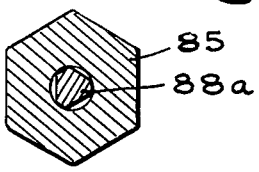
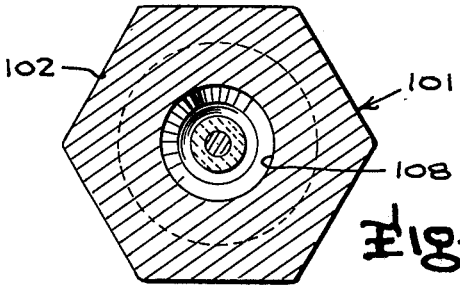
Fig-8
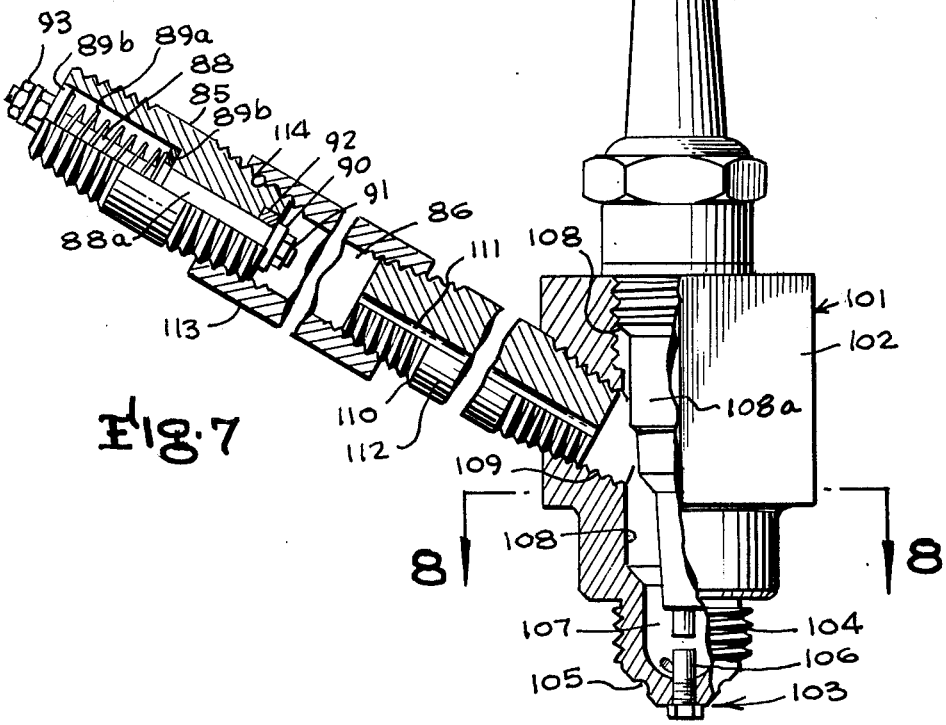
Fig-7

SPARK PLUG CONSTRUCTION FOR LEAN MIXTURE BURNING INTERNAL COMBUSTION ENGINES

This is a Continuation-in-Part of our Application Ser. No. 558,921 filed Mar. 17, 1975 now abandoned.

BACKGROUND AND OBJECTS OF THE INVENTION

The present invention relates in general to internal combustion engines, and more particularly to the construction of spark plugs or spark plug housing adaptors for each cylinder of multi-cylinder internal combustion engines providing an ignition chamber formed by a portion of the spark plug immediately surrounding the electrodes of the spark plug for ignition of a rich combustible mixture producing flame for readily igniting a lean combustible mixture.

Heretofore, it has been known that relatively lean combustible mixtures designed to maximize gasoline mileage in internal combustion engines is frequently difficult to ignite and often does not burn completely. This results in frequent misfiring or failure to fire the lean combustion mixture in the main combustion chambers of the internal combustion engines using them and also increases the air pollution caused by the exhaust from the internal combustion engine, both due to failure of ignition when this occurs and also due to failure of the mixture to burn completely even though ignition may occur.

Some efforts to reduce air pollution resulting from noxious gases in the exhaust of internal combustion engines have involved addition of air injection pumps to the internal combustion engine, exhaust recycling systems to cut down the formation of smog producing chemicals, and use of catalytic converters fitted into the exhaust system of the automobile to convert harmful constitutents of the engine exhaust into harmless chemical components or compositions. All of these measures involve adding on of additional or auxiliary devices to automobiles, and in most cases have reduced the gasoline mileage attainable, thus increasing the consumption of fuel energy and further compounding the already difficult energy consumption problem.

Efforts have been made to achieve greater fuel economies in internal combustion engines and concurrently obtain greater reliability of ignition and more complete combustion by redesigning the engine block to define a smaller auxiliary combustion chamber or ignition chamber communicating with each respective main combustion chamber with a spark plug associated with each auxiliary combustion chamber having its electrode gap in the auxiliary combustion chamber and with a valved fuel supply line to the auxiliary combustion chamber providing a rich fuel-air mixture to the auxiliary combustion chamber for reliable ignition and a second fuel mixture supply conduit supplying a lean fuel-air mixture to the main combustion chamber. Examples of such arrangements are found in the earlier U.S. Pat. Nos. 3,844,259 and 3,853,097 granted to Honda Motor Co., Ltd. In such prior art systems the rich air-fuel mixture is supplied through an intake valve to the auxiliary combustion chamber specially formed in the engine block during the downstroke or suction stroke of the piston for the associated cylinder, and the rich mixture which is readily ignited by the associated spark plug produces a flame discharge communicating with the lean mixture supplied to the main combustion chamber during the same suction stroke of the piston to achieve more reliable ignition and more complete combustion of the lean mixture. However, the designs employed in those prior patented systems require specially formed engine blocks designed so that the configuration of the engine block provides for the auxiliary combustion chamber or ignition chamber in which ignition of the rich fuel-air mixture occurs to produce the flame which achieves ignition of the lean fuel-air mixture in the main combustion chamber. That system of ignition is not adaptable for use in already existing conventional internal combustion engine blocks, because new engine blocks would be required to provide the special auxiliary combustion chamber configuration and valved rich mixture intake supply system needed in those prior art designs.

An object of the present invention is the provision of a novel replacement spark plug assembly for internal combustion engines wherein the replacement spark plug assembly incorporates an apertured shell or dome structure surrounding the electrode gap to define an auxiliary ignition chamber and includes within the assembly a valved intake conduit for communication with a first fuel mixture source such as a rich mixture supply line to admit the first mixture to the auxiliary ignition chamber to achieve ignition and production of flame for igniting a second fuel mixture in the main combustion chamber of the associated engine cylinder.

Another object of the present invention is the provision of a novel spark plug construction which may be fitted into conventional automobile engine heads in place of the standard spark plug and provide for ignition of a rich fuel-air mixture in a limited size ignition chamber defined by the spark plug to produce flame. for ensuring ignition and more complete burning of a lean fuel-air mixture in the combustion chamber of the associated engine cylinder.

Another object of the present invention is the provision of a novel spark plug construction as defined in either of the two preceding paragraphs, wherein ignition in the auxiliary ignition chamber defined by the spark plug assembly is produced in such a manner as to create high velocity turbulent air currents in the ignition chamber which deters buildup of deposits within the chamber and on the spark gap electrodes of the spark plug.

Other objects, advantages and capabilities of the present invention will become apparent from the following detailed description, taken in conjunction with the accompanying drawings showing a preferred embodiment of the invention.

BRIEF DESCRIPTION OF THE FIGURES

FIG. 5 is a vertical section view of another form of the spark plug construction; incorporating a different branch conduit valve structure, shown to enlarged scale;

FIG. 6 is a section view taken along the line 6—6 of FIG. 5;

FIg. 7 is a vertical section view of yet another form of the spark plug construction, wherein a conventional spark plug is assembled in an adaptor housing member; and FIG. 8 is a bottom view of the assembly of FIG. 7.

DETAILED DESCRIPTION OF A PREFERRED EMBODIMENT

Figure 1:
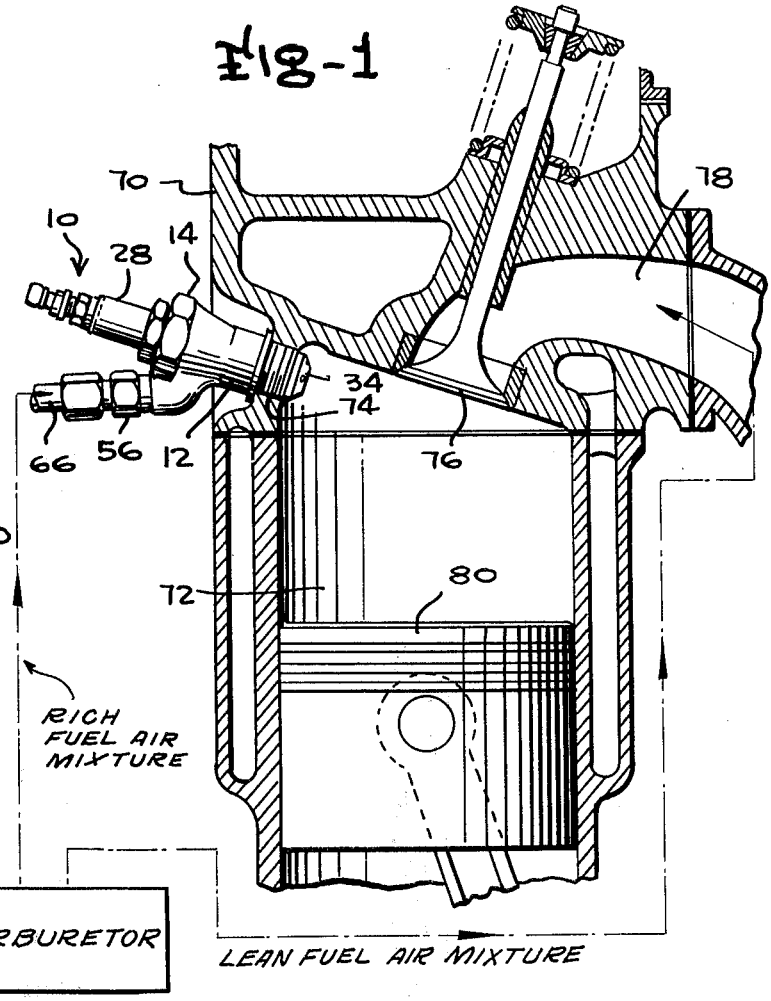
FIG. 1 is a diagrammatic section view of the upper portion of the cylinder portion and cylinder head portion of an engine having a spark plug constructed in accordance with the present invention, and indicating diagrammatically a carburetor and fuel-air supply lines therefrom to the cylinder head and spark plug.
Figure 2:
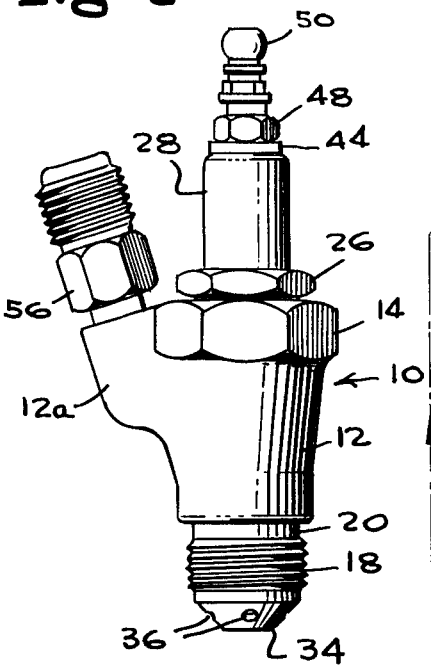
FIG. 2 is a side elevation view of the spark plug of the present invention.
Figure 3:
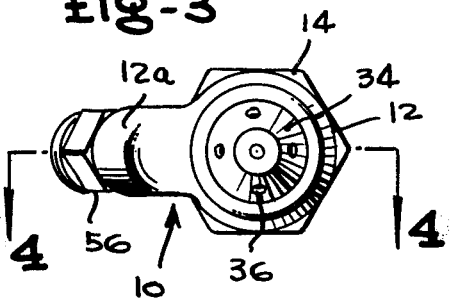
FIG. 3 is a bottom plan view of the spark plug.
Figure 4:
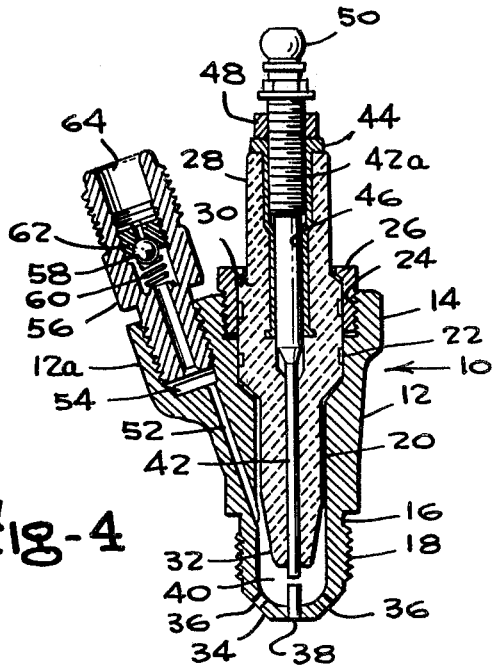
FIG. 4 is a vertical section view of the spark plug, taken along the line 4—4 of FIG. 3.

Referring to the drawings, wherein like reference characters designate corresponding parts throughout the several figures, and particularly to FIGS. 1–4, inclusive, the improved spark plug of the present invention, indicated generally by the reference character 10, has the general configuration of conventional spark plugs, and comprises a lower metallic housing portion 12 having a hexagonal nut formation 14 at its upper portion and having a lower portion 16 of reduced diameter which is externally threaded at 18 to screw into an opening in the cylinder head of an internal combustion engine. The lower housing portion 12 defines an upwardly opening bore through the major portion of its length having a lower portion 20 of constricted cross section and an upper portion 22 of larger cross section terminating in an internally threaded enlarged upper end portion 24 threaded to receive an insulator retainer nut 26 therein. Removably seated in the bore portions 20 and 22 is a generally cylindrical tubular insulator body 28 formed of hard ceramic material such as that conventionally used for spark plugs having an enlarged intermediate collar or flange formation 30 seated against the transition shoulder between the lower and upper bore portions 20, 22 and clamped against the transition shoulder by the insulator retainer nut 26.

The lower gradually tapering portion 32 of the insulator body 28 is enclosed by the threaded part of the lower portion 16 of the metallic housing 12 and by a dome portion 34 integral with the threaded portion and preferably having a frustoconical configuration providing a plurality of circumferentially spaced inclined ports 36. The lower end of the dome formation 34 is flat and preferably formed at its center with a short rod section forming the negative electrode 38 of the spark plug. The housing member 12 with its lower dome formation 34 and the lower tapered end portion 32 of the insulator body 28 cooperate to define the ignition chamber or auxiliary combustion chamber 40 around the gap defined by the negative electrode 38 and the elongated positive center electrode rod 42 extending through the center of the insulator body 28.

The insulator body 28 is suitably bored to accommodate the center electrode rod 42 along the center axis thereof, and means are provided for adjustment of the spark gap by axial adjustment of the center electrode rod 42 in the insulator body 28. To this end, the upper portion of the center electrode rod 42 has a threaded portion **42*a* surrounded by an annular bushing 44 which extends into the larger diameter upper portions of the central bore 46 through the insulator body and having threads either preformed in the bore of the bushing 44 or deformed therein by the threaded portion of the center electrode 42 for threadedly coupling the center electrode rod in the bushing so that rotation of the center electrode rod 42 effects axial movement of the center electrode within the insulator body 28. A lock nut 48 is threaded onto the threaded portion of the center electrode rod 42 immediately above and bearing against the bushing 44 to lock the center electrode in its adjusted position, and a cap 50 may be braised or otherwise fixed on the top of the center electrode rod 42** to provide a suitable terminal for attachment of the ungrounded conductor from the automobile engine distributor to the center electrode.

An inclined lateral branch excursion **12*a* of the metallic housing member 12 provides a rich supply conduit 52 communicating with the ignition chamber 40 at a level spaced slightly above the lower end of the tapered portion 32 of the insulator body and inclining upwardly to an enlarged diameter internally threaded bore portion 54 into which an intake valve fitting 56 is threaded. The intake valve fitting 56 has a lower threaded end portion threaded into the bore portion 54 and defines a valve chamber for a valve assembly comprising a fuel back pressure ball valve 58 normally urged by a coil spring 60 against a valve seat member 62 to close off communication from the passage forming the fuel intake port 64 opening through the upper end of the fitting 56 to the lower end of the bore portion 54 and connected to rich fuel supply conduit 52 except when the piston of the associated engine cylinder is executing a downstroke or suction stroke producing suction conditions in the cylinder area communicating with the ignition chamber 40. The intake valve fitting 56 is externally threaded at its upper end for attachment to a rich fuel line, indicated at 66 extending to a carburetor which supplies a rich fuel-air mixture to the fuel supply conduit 52 and ignition chamber 40** communicating therewith.

The spark plug 10 of the present invention is threaded into the usual threaded port for the conventional spark plug for the engine head 70 defining the top of the cylinder 72 to be served by the spark plug, for example, in the lateral inclined position indicated diagrammatically in FIG. 1 wherein the spark plug is threaded into the usual spark plug port 74 in the upper portion of the cylinder 72 adjacent the fuel inlet valve 76 controlling the intake port 78 from the main carburetor.

In the operation of the engine with spark plugs of the construction hereinabove described mounted in the top of each cylinder, it will be appreciated that when the piston 80 moves downwardly during the suction stroke, the reduced pressure in the cylinder 72 permits the lean fuel-air combustible mixture to be drawn from the main carburetor through the intake port 78 into the main combustion chamber of the cylinder 72. Concurrently, the reduced pressure in the cylinder 72 communicated to the ball valve 58 opens the ball valve against the action of its coiled spring 60 to draw the rich fuel-air combustion mixture from the associated caburetor, for example, from a rich mixture outlet of the same carburetor supplying the lean mixture, through the rich fuel line 66 and rich fuel supply passage 52 into the spark ignition chamber 40 defined by the dome portion 34 at the lower end of the metallic housing member 12. When the distributor then supplies voltage to the cap of the positive center electrode 42 of the spark plug, the spark between the electrodes 42 and 38 of the spark plug ignites the rich mixture in the ignition chamber 40 immediately surrounding the spark gap, and the resultant flame produced by the ignition exits as a hot jet of flame whirling through the ignition ports 36 into the upper portion of the main combustion chamber defined by the cylinder 72 to ignite the lean mixture in the main combustion chamber. The flame is discharged in a whirling pattern due to the disposition of the ignition ports 36 in the dome 34, as the axes of the ports are inclined downwardly and outwardly at a suitable angle, for example, approximately 45°, from the vertical center axis of the spark plug and are also inclined at a suitable horizontal angle of, for example, approximately 45° from the radii of the center axis of the spark plug as indicated in broken lines at 36A in FIG. 3. The retroturbo action produced by this whirling flame discharged from the ignition chamber 40 prevents the buildup of deposits within the ignition chamber, thus reducing the need for periodic maintenance and extending the performance life of the spark plug, and ensures reliable ignition of the lean air-fuel mixture in the main combustion chamber which, through the use of the leaner gasoline mixture for the primary power for propelling the automobile, improves the efficiency of the engine, reduces gasoline consumption, and reduces the emission of noxious exhaust fumes because of the more complete burning of the mixture achieved with this spark plug construction.

A modified form of the improved spark plug construction is illustrated in FIGS. 5 and 6, which is generally like the FIG. 1–4 form except for the structure of the valve in the branch passage 52 of the branch excursion 12*a* communicating with the ignition chamber 40. The components of this FIG. 5–6 embodiment which duplicate those of the FIG. 1–4 embodiment are identified by the same reference characters used in describing the FIG. 1–4 embodiment, while the spark plug assembly is generally indicated by reference character 10′. In the modified form, the intake valve fitting or body 85 is externally threaded at both its lower and upper ends, the lower threaded end being threaded into the bore portion 54, defining an enlarged valve chamber 86 immediately below the lower end of fitting 85 in the lower part of the larger bore portion of excursion 12*a* into which the fitting 85 is threaded. The fitting 85 has a lower constricted or smaller diameter bore portion 87*a* of cylindrical configuration for receiving and slidably guiding a valve stem 88 and an upper enlarged bore portion 87*b* opening through the upper end of the fitting 85 for housing a valve biasing spring assembly 89.

The portion of the valve stem member 88 which slides in the constricted bore portion 87*a* is of fluted or non-round configuration, as by providing flats along the side of the larger diameter stem portion 88*a* as shown in FIG. 6 to provide passages for the gas mixture to flow through the bore portion 87*a*. The lower end portion of the valve stem member 88 is of slightly reduced diameter and is threaded, and an annular valve 90, for example, of high temperature steel is assembled on the threaded lower stem portion and is held thereon by nut 91 which is, for example, shrunk fit at elevated temperature onto the threaded portion to lock the valve thereon or the valve may be machined from one piece of high temperature steel. An annular valve seat insert 92, also of high temperature steel or similar material, is positioned for example, by shrink fitting, in a conforming enlargement at the lower end of the constricted bore portion 87*a*. The valve member 90 is normally biased to closed position against the valve seat insert 92 by the spring assembly 89, formed of a coil spring 89*a* and a pair of spiders or relieved washers 89*b* surrounding an upper reduced portion of the valve stem and shaped or relieved to pass the gaseous mixture therearound. The lower spider or washer 89*b* bears against the upper transition wall of the constricted bore portion 87*a* and the upper one is held by a suitable lockwasher and nut indicated at 93 or by a snap ring. The fuel intake supply line 66 extending to the source of the fuel mixture to be supplied through the branch conduit 52 connected to the upper end of the fitting 85.

The operation of the engine with the spark plug assembly of the construction shown in FIGS. 5–6 is similar to that of the previously described embodiment in that when the piston for the associated cylinder is moving through its down stroke or suction stroke, the reduced pressure in the cylinder causes the valve member 90 on the slidable stem 88 to move downwardly away from the valve seat insert 92 against the bias of the spring assembly 89, opening the valve in the branch passage and permitting the fuel mixture designed to ensure combustion in the auxiliary ignition chamber 40 to be drawn through the valve assembly and conduit 52 into the ignition chamber 40. As also occurred in the previously described embodiment, on the next upstroke or compression stroke of the cylinder, the fuel drawn through the branch conduit 52 and valve from whatever source is connected thereto, it is then mixed within the auxiliary ignition chamber 40 with the regular fuel-air mixture, for example the lean fuel-air mixture, which was also supplied to the cylinder 72 during the suction stroke, causing a thorough intermixing within the ignition chamber 40 by what we call "turbo action" as gases are forced through the horizontally and vertically inclined ignition ports 36. Then when the distributor supplied voltage to the cap of the positive center electrode 42 of the spark plug at the conclusion of the upstroke or compression stroke, the mixture in the ignition chamber 40 readily ignites and the resultant flame produced by the ignition exits as a hot jet of flame whirling through the ignition ports 36 into the upper portion of the main combustion chamber defined by the cylinder 72, by what we call "retroturbo action," to ensure ignition of the mixture in the main combustion chamber.

Another embodiment is illustrated in FIGS. 7–8, wherein an adaptor generally indicated at 101 is designed to be assembled with the use of a conventional spark plug or a slightly modified conventional plug having its negative electrode removed, and is arranged to have components assembled thereto defining the branch passage and the valve mechanism therefor, thus permitting the concept of the present invention to be realized with substantially conventional spark plugs. In the embodiment shown in FIGS. 7–8, the adaptor 101 comprises a body 102 shaped at its lower end to define a dome portion 103 shaped like that of the previously described embodiments, which is externally threaded as indicated at 104, along its upper portion to screw into the usual spark plug opening in the cylinder head of an internal combustion engine. The lower end portion of the dome formation is of substantially the same configuration as the frustoconical wall of the previous embodiments and is provided with a plurality of circumferentially spaced inclined ports 105 shaped and inclined like the ports 36. The lower end of the dome formation 103 is flat and is provided with a threaded opening at its center to receive an elongated electrode member 106 providing the center negative electrode or cathode of the spark plug in cases where the regular lower negative electrode of the conventional spark plug is removed so that the gap is defined by the center positive electrode extending through the standard spark plug and this negative electrode member 106. The adaptor 101 preferably has a hexagonal nut formation along its upper body portion to facilitate mounting of the adaptor in the cylinder head, and defines a chamber extending upwardly from and communicating with the ignition chamber 107 defined by the dome portion to receive the lower body portion of the conventional spark plug, the upper chamber 108 being threaded at its upper end to receive the threads of the usual spark plug. In most cases, a ceramic ferrule 108*a* is proved in the chamber 108 to regulate the volume of the ignition chamber 107. A branch bore 109 extends from the chamber 108 and is inclined at an angle thereto, and is internally threaded to receive the threaded lower end of the intake valve fitting 85 of the same construction described in connection with FIGS. 5–6 in one embodiment, or to receive an elongated preheating conduit section 110, providing an internal fuel conducting passage 111 of selected length extending along the center axis of a metallic body 112 which is externally threaded at both ends. The threaded lower end of the metallic body 112 is threaded into the branch passage or bore 109 of the adaptor 101, and the upper end may be threaded into a connector 113 having an internal bore extending therethrough with internally threaded end portions 114 at its opposite ends sized and threaded appropriately to receive the threaded upper end of the preheating fuel conduit section 110 and the lower end of the intake valve fitting 85. The intake valve assembly for the embodiment of FIGS. 7–8 has the same construction as the intake valve assembly of the embodiments of FIGS. 5–6 and the parts thereof are identified by the same reference characters.

The operation of the embodiment illustrated in FIGS. 7–8 is like that of the previously described embodiments, except that the elongated metallic preheating fuel conduit section 110 provides an elongated small conduit of appropriate length surrounded by metallic walls which become heated from the heat of the engine block and surrounding components and effect preheating of the fuel being supplied to the ignition chamber 107 defined by the dome portion 103. This preheating conduit section 110 provides a useful variation in which the branch passage defined by the preheating conduit section 110, the branch bore 109, the connector 113 and the valve assembly 85 may be connected through a fuel conduit, and through a distributing manifold and metering valve, directly to a source of raw fuel, for example by connecting it directly to a standard carburetor fuel reservoir, or directly to the fuel line attached to the fuel pump. With this arrangement, a small amount of the raw fuel regulated by the metering valve is drawn through the opened valve assembly 85 during the downstroke or suction stroke of the piston, to flow through the center passage 111 in the preheating fuel conduit section 110 and into the ignition chamber 107 defined by the dome portion 103 of the adaptor. This raw fuel is drawn into the plug chamber in very minute amounts during the downstroke of the piston, due to the configuration and construction of the valve assembly. When the engine is cold, this raw fuel drawn into the ignition chamber 107 is atomized by the turbo action which is produced in the ignition chamber 107 during the upstroke or compression stroke of the piston, during which some of the lean fuel-air mixture which was supplied to the main combustion chamber during the previous suction stroke is forced into the ignition chamber via the angled ports 105 to give the necessary air to the raw fuel within the ignition chamber for effective firing. Thus the fuel supplied from the branch passage into the ignition chamber is atomized and intermixed with lean fuel-air mixture by the turbo action within the ignition chamber during the upstroke or compression stroke and is then fired when voltage is supplied by the distributor to the spark plug electrodes. When the engine becomes hot, the raw fuel being supplied through the branch passage as it flows through the passage 111 of the fuel conduit section 110 becomes preheated, and is then vaporized upon contact with the hot surfaces within the ignition chamber assisted further by the turbo action occurring on the compression stroke and intermixing with the lean fuel-air supply introduced from the main combustion chamber. The vaporization of the fuel by contact with the hot surfaces defining the walls and surfaces in the ignition chamber eliminate the possibility of condensation and resulting hydrocarbon emissions, while the turbo action which occurs within the ignition chamber due to the shaping and inclination of the ports eliminates the danger of a blowout of the spark by keeping the fuel droplets suspended under cold start conditions.

It will be appreciated, of course, that, if desired, either the first described embodiment of FIGS. 1–4 or FIGS. 5–6 could also be used in a system in which raw, unmixed fuel, for example as obtained from the carburetor float chamber or directly from a fuel line, could be supplied to the valved branch passage 52 controlled by the valve member 58 (FIG. 4) or 90 (FIG. 5) so that during the downstroke or suction stroke of the piston, a small amount of the raw fuel is drawn through the passage 52 into the ignition chamber 40, where it is intermixed by the turbo action with some of the lean air-fuel mixture introduced through the port 36 into the ignition chamber during the following compressions stroke of the piston to provide a rich fuel-air mixture in the ignition chamber 40 which fires when voltage is applied to the electrodes of the spark plug to ensure ignition of the lean fuel-air mixture in the main combustion chamber from the swirling flames thereupon discharged through the ports 36. Also, if desired, rather than introducing raw fuel of the same type that is employed in the lean fuel-air mixture supplied to the main combustion chamber, one may introduce a distinctly different ignitible fuel through the valved branch passage into the ignition chamber of any of the previously described embodiments to ensure ignition which then produces flames discharged through the ports to ensure ignition of the lean fuel-air mixture in the main combustion chamber.

It has also been found that the retroturbo action within the main cylinder chamber within the area surrounding the dome formation of the spark plug construction caused by the exit of the swirling flames from the angled ports 36 or 105 into the main combustion chamber results in more complete burning of the lean mixture in the cylinder, because of the resultant intermixing of the relatively colder fuel-air mixture accumulating around the relatively cold cylinder walls (which normally undergoes less complete combustion and causes hydrocarbon emissions), with the hotter fuel-air mixture within the main combustion chamber, thus reducing hydrocarbon emissions.

What is claimed is:

1. An internal combustion engine for minimizing unwanted emissions and achieving fuel economies by combustion of a lean fuel-air mixture to drive the pistons of the engine, a cylinder bore in the engine having a crank-connected piston movable therein and having walls coactively defining with the piston a main combustion chamber above the piston, means providing a first and second different fuel sources, the first fuel source providing a lean fuel-air mixture, a first fuel supply conduit connected to the first fuel source for supplying the lean fuel-air mixture to said main combustion chamber, a second fuel conduit connected to the second fuel source, a spark plug mounted in the engine communicating with the main combustion chamber having an elongated body supporting electrodes defining a spark gap at one end thereof, the spark plug including a metallic tubular dome defining a spark ignition chamber of limited volume surrounding and enclosing the spark gap and having exit ports for discharge of flame outwardly therethrough, screw thread formations on the spark plug body for screw mounting the spark plug in a conventional threaded spark plug opening in the engine at a position where the dome formation protrudes inwardly within the upper portion of the main combustion chamber, the spark plug body including a branch formation having a valved branch passage therethrough opening at its inner end into said spark ignition chamber within said dome and connected at its outer end to said second fuel conduit to supply fuel from the second fuel source to the spark ignition chamber for providing a rich fuel-air mixture therein to be ignited by a spark at the spark gap and produce flames discharging through said exit ports into the main combustion chamber to ignite the lean fuel-air mixture in the latter, valve means in said branch passage for introducing the second source fuel into the spark ignition chamber, the engine having valve means for introducing the lean fuel-air mixture through said first supply conduit directly into the main combustion chamber, said valve means in said branch passage comprising a valve seat and a valve member resiliently biased to normally closed position against said valve seat and responsive to reduced pressure communicated through said branch passage from said main combustion chamber during a suction stroke of the piston to open and admit the fuel from said second fuel source to the spark ignition chamber defined within said dome said elongated body of said spark plug housing an elongated center electrode rod extending along a rectilinear center axis throughout the length of the spark plug and terminating in an externally exposed terminal cap formation at the end of the center electrode opposite the spark gap, and said branch passage extending along a substantially rectilinear axis inclined at an acute angle to the axis of said center electrode diverging laterally therefrom progressively from the inner end of the branch passage to its outer end whereby the outer end of said branch passage defines a connection to be coupled to said second fuel conduit located laterally adjacent the terminal cap formation of said center electrode.

2. An internal combustion engine for minimizing unwanted emissions and achieving fuel economies by combustion of a lean fuel-air mixture to drive the pistons of the engine, a cylinder bore in the engine having a crank-connected piston movable therein and having walls coactively defining with the piston a main combustion chamber above the piston, means providing a first and second different fuel sources, the first fuel source providing a lean fuel-air mixture, a first fuel supply conduit connected to the first fuel source for supplying the lean fuel-air mixture to said main combustion chamber, a second fuel conduit connected to the second fuel source, a spark plug mounted in the engine communicating with the main combustion chamber having an elongated body supporting electrodes defining a spark gap at one end thereof, the spark plug including a metallic tubular dome defining a spark ignition chamber of limited volume surrounding and enclosing the spark gap and having exit ports for discharge of flame outwardly therethrough, screw thread formations on the spark plug body for screw mounting the spark plug in a conventional threaded spark plug opening in the engine at a position where the dome formation protrudes inwardly within the upper portion of the main combustion chamber, the spark plug body including a branch formation having a valved branch passage therethrough opening at its inner end into said spark ignition chamber within said dome and connected at its outer end to said second fuel conduit to supply fuel from the second fuel source to the spark ignition chamber for providing a rich fuel-air mixture therein to be ignited by a spark at the spark gap and produce flames discharging through said exit ports into the main combustion chamber to ignite the lean fuel-air mixture in the latter, valve means in said branch passage for introducing the main source fuel into the spark ignition chamber, the engine having valve means for introducing the lean fuel-air mixture through said first supply conduit directly into the main combustion chamber, said means providing said first and second fuel sources being a carburetor supplying said lean fuel-air mixture and supplying a rich fuel-air mixture as said second fuel source, said elongated body of said spark plug housing an elongated center electrode rod extending along a rectilinear center axis throughout the length of the spark plug and terminating in an externally exposed terminal cap formation at the end of the center electrode opposite the spark gap, and said branch passage extending along a substantially rectilinear axis inclined at an acute angle to the axis of said center electrode diverging laterally therefrom progressively from the inner end of the branch passage to its outer end whereby the outer end of said branch passage defines a connection to be coupled to said second fuel conduit located laterally adjacent the terminal cap formation of said center electrode.

3. An internal combustion engine as defined in claim 1, including a screw thread formation on said center electrode threadedly coupled to internal screw threads on said elongated body for axial movement of the center electrode upon rotation thereof relative to the spark plug body for adjustment of the spark gap, and lock nut means coupled on the threaded formation on said center electrode and abutting said spark plug body to fix the position of said center electrode.

4. An internal combustion engine as defined in claim 2, including a screw thread formation on said center electrode threadedly coupled to internal screw threads on said elongated body for axial movement of the center electrode upon rotation thereof relative to the spark plug body for adjustment of the spark gap, and lock nut means coupled on the threaded formation on said center electrode and abutting said spark plug body to fix the position of said center electrode.

5. An internal combustion engine as defined in claim 1, wherein said electrodes defining said spark gap in said spark ignition chamber include an electrode member having screw thread formations thereon threadedly coupled to said tubular dome in electrical communication therewith for adjustment toward and away from a companion electrode member forming the other of said electrodes for varying the spark gap therebetween.

6. An internal combustion engine as defined in claim 1, wherein said exit ports in said dome are cylindrical openings having their center axes inclined at a vertical angle to the center axis of the spark plug body when the latter is disposed vertically and inclined at a horizontal angle to radial axes of said center axis extending through the centers of the exit ports to direct the flames discharged therethrough in a whirling path producing turbo action adjacent the spark gap.

7. An internal combustion engine as defined in claim 2, wherein said exit ports in said dome are cylindrical openings having their center axes inclined at a vertical angle to the center axis of the spark plug body when the latter is disposed vertically and inclined at a horizontal angle to radial axes of said center axis extending through the centers of the exit ports to direct the flames discharged therethrough in a whirling path producing turbo action adjacent the spark gap.

8. An internal combustion engine as defined in claim 1, wherein said exit ports in said dome are cylindrical openings having their center axes inclined at a vertical angle of about 45° to the center axis of the spark plug body when the latter is disposed vertically and inclined at a horizontal angle of about 45° to radial axes of said center axis extending through the centers of the exit ports to direct the flames discharged therethrough in a whirling path producing turbo action adjacent the spark gap.

9. An internal combustion engine as defined in claim 2, wherein said exit ports in said dome are cylindrical openings having their center axes inclined at a vertical angle of about 45° to the center axis of the spark plug body when the latter is disposed vertically and inclined at a horizontal angle of about 45° to radial axes of said center axis extending through the centers of the exit ports to direct the flames discharged therethrough in a whirling path producing turbo action adjacent the spark gap.

10. An internal combustion engine as defined in claim 3 wherein said exit ports in said dome are cylindrical openings having their center axes inclined at a vertical angle of about 45° to the center axis of the spark plug body when the latter is disposed vertically and inclined at a horizontal angle of about 45° to radial axes of said center axis extending through the centers of the exit ports to direct the flames discharged therethrough in a whirling path producing turbo action adjacent the spark gap.

11. An internal combustion engine as defined in claim 4, wherein said exit ports in said dome are cylindrical openings having their center axes inclined at a vertical angle of about 45° to the center axis of the spark plug body when the latter is disposed vertically and inclined at a horizontal angle of about 45° to radial axes of said center axis extending through the centers of the exit ports to direct the flames discharged therethrough in a whirling path producing turbo action adjacent the spark gap.

* * * * *